US010561254B2

(12) United States Patent
Ingraham et al.

(10) Patent No.: US 10,561,254 B2
(45) Date of Patent: Feb. 18, 2020

(54) CHILD TRAY ASSEMBLY AND MULTI-FUNCTION HIGH CHAIR

(71) Applicant: Wonderland Switzerland AG, Steinhausen (CH)

(72) Inventors: Jerry Ingraham, Denver, PA (US); Jonathan Pacella, Coatesville, PA (US); Nathanael Saint, Morgantown, PA (US); Jennifer Sheldrick, Malvern, PA (US); Patrick Bowers, Hockessin, DE (US)

(73) Assignee: Wonderland Switzerland AG, Steinhausen (CH)

( * ) Notice: Subject to any disclaimer, the term of this patent is extended or adjusted under 35 U.S.C. 154(b) by 139 days.

(21) Appl. No.: 15/927,095

(22) Filed: Mar. 21, 2018

(65) Prior Publication Data

US 2018/0279801 A1 Oct. 4, 2018

Related U.S. Application Data

(60) Provisional application No. 62/619,361, filed on Jan. 19, 2018, provisional application No. 62/481,325, filed on Apr. 4, 2017.

(51) Int. Cl.
*A47D 1/00* (2006.01)

(52) U.S. Cl.
CPC ..... *A47D 1/0083* (2017.05)

(58) Field of Classification Search
CPC .... A47D 1/0083; A47D 1/008; A47D 1/0081; A47D 1/0085
USPC ..... 297/150, 140, 144, 148, 149
See application file for complete search history.

(56) References Cited

U.S. PATENT DOCUMENTS

| | | | | |
|---|---|---|---|---|
| 2,418,731 A | | 4/1947 | Seitz | |
| 2,516,774 A | | 7/1950 | Gottfried | |
| 2,779,389 A | | 1/1957 | Pearl | |
| 5,586,800 A | * | 12/1996 | Triplett | A47D 1/0085 297/148 |
| 5,755,489 A | | 5/1998 | Rossman | |
| 5,951,102 A | | 9/1999 | Poulson | |
| 6,419,312 B1 | * | 7/2002 | Flannery | A47D 1/0081 297/149 |

(Continued)

FOREIGN PATENT DOCUMENTS

| | | |
|---|---|---|
| CN | 202589009 U | 12/2012 |
| CN | 204306474 U | 5/2015 |

(Continued)

*Primary Examiner* — Mark R Wendell
(74) *Attorney, Agent, or Firm* — Winston Hsu

(57) ABSTRACT

A child tray assembly includes a first tray and a second tray. The first tray is slidably disposed on a child seat. The first tray includes a first tray body and a first actuator. The second tray is detachably disposed on the first tray. The second tray includes a second tray body, a second actuator and a sliding latch. The second tray body can be installed on the first tray body by a first engaging portion of the sliding latch. The first actuator can be driven by the second actuator to allow the first tray to slide relative to the child seat when the second tray is disposed on the first tray. Furthermore, lower tubes can be installed on the second tray body by a second engaging portion of the sliding latch to form a small table when the second tray is detached from the first tray.

10 Claims, 10 Drawing Sheets

(56) References Cited

U.S. PATENT DOCUMENTS

| | | | | |
|---|---|---|---|---|
| 7,011,363 | B1 * | 3/2006 | Connery | A47D 15/00 297/153 |
| 7,673,934 | B2 | 3/2010 | Bearup | |
| 8,567,867 | B2 | 10/2013 | Arnold, IV | |
| 8,602,490 | B2 | 12/2013 | Tsai | |
| 8,919,889 | B2 | 12/2014 | Kane | |
| 9,635,955 | B2 | 5/2017 | Greger | |
| 2003/0197403 | A1 * | 10/2003 | Greger | A47D 1/0085 297/148 |
| 2008/0088162 | A1 | 4/2008 | Fritz | |
| 2008/0258527 | A1 | 10/2008 | Gower | |
| 2009/0015041 | A1 | 1/2009 | Centracco | |
| 2012/0086240 | A1 | 4/2012 | Tsai | |
| 2013/0241248 | A1 | 9/2013 | Kostyniak | |
| 2016/0174727 | A1 | 6/2016 | Haut | |
| 2016/0192787 | A1 | 7/2016 | Perrin | |
| 2016/0309910 | A1 * | 10/2016 | Sclare | A47D 1/0085 |
| 2017/0043683 | A1 | 2/2017 | Yang | |
| 2017/0119172 | A1 | 5/2017 | Sclare | |
| 2017/0251826 | A1 * | 9/2017 | Sclare | A47D 1/004 |
| 2017/0258244 | A1 | 9/2017 | Waldman | |

FOREIGN PATENT DOCUMENTS

| | | | |
|---|---|---|---|
| DE | 92 16 287 | U1 | 5/1993 |
| DE | 201 00 083 | U1 | 4/2001 |
| DE | 10 2015 122 122 | A1 | 6/2016 |
| EP | 1 364 603 | A2 | 11/2003 |
| EP | 2 008 550 | A1 | 12/2008 |
| EP | 2 092 857 | A2 | 8/2009 |
| FR | 2 919 164 | A1 | 1/2009 |
| GB | 2534683 | A | 8/2016 |
| WO | 2004/086916 | A2 | 10/2004 |
| WO | 2009/158134 | A1 | 12/2009 |

* cited by examiner

CHILD TRAY ASSEMBLY AND MULTI-FUNCTION HIGH CHAIR

CROSS REFERENCE TO RELATED APPLICATIONS

This application claims the benefit of U.S. Provisional Patent Application No. 62/481,325, filed on Apr. 4, 2017, and US Provisional Patent Application No. 62/619,361, filed on Jan. 19, 2018, which are hereby incorporated by reference in their entirety.

BACKGROUND OF THE INVENTION

1. Field of the Invention

The present invention relates to a child product, and more particularly, to a child tray assembly and a multi-function high chair therewith.

2. Description of the Prior Art

In order for caregivers to feed and care for their children, a number of child products are employed. A High chair provides a means for the caregivers to place their children for spoon or bottle feeding. The conventional high chair usually affords a number of convenience features, such as a reclining seatback and a height adjustment mechanism. However, sometimes, the conventional high chair still cannot allow the caregivers to adequately watch or interact with their children. Therefore, there is a need for improvement of the high chair.

SUMMARY OF THE INVENTION

Therefore, it is an objective to provide a child tray assembly and a multi-function high chair to allow the caregivers to adequately watch or interact with their children.

In order to achieve the aforementioned objective, the present invention discloses a child tray assembly adapted for a child seat. The child tray assembly includes a first tray and a second tray. The first tray is slidably disposed on the child seat. The first tray includes a first tray body and a first actuator installed on the first tray body for allowing the first tray body to slide relative to the child seat. The second tray is detachably disposed on the first tray. The second tray includes a second tray body and a second actuator installed on the second tray body. The second actuator is located at a position corresponding to the first actuator when the second tray body is disposed on the first tray body. The first actuator is driven by the second actuator to allow the first tray body to slide relative to the child seat when the second tray body is disposed on the first tray body.

According to an embodiment of the present invention, the first tray further includes a driven component and an engaging component. The driven component is connected to the first actuator and the engaging component, and the first actuator drives the driven component to disengage the engaging component from the child seat to allow the first tray body to slide relative to the child seat.

According to an embodiment of the present invention, the first tray further includes at least one sliding track installed on the first tray body, and the first tray body is slidably disposed on the child seat by the at least one sliding track.

According to an embodiment of the present invention, the first actuator is located on a front side of the first tray body, and the second actuator is located on a front side of the second tray body.

According to an embodiment of the present invention, the second tray further includes a resilient component abutting against the second actuator to bias the second actuator to separate from the first actuator.

In order to achieve the aforementioned objective, the present invention further discloses a child tray assembly adapted for a child seat. The child tray assembly includes at least one support portion and a tray. The at least one support portion is slidably disposed on the child seat. The tray is detachably disposed on the at least one support portion. The tray includes a tray body and at least one sliding latch slidably disposed on the tray body. At least one assembling portion is formed on the tray body for insertion of at least one lower tube. The at least one sliding latch includes a first engaging portion and at least one second engaging portion. The first engaging portion is for engaging with the at least one support portion. The at least one second engaging portion is for engaging with the at least one lower tube inserted within the at least one assembling portion at a locking position.

According to an embodiment of the present invention, at least one engaging recess is formed on a side of the at least one support portion, and the at least one sliding latch is located at a position corresponding to the at least one engaging recess for engaging with or disengaging from the at least one engaging recess.

According to an embodiment of the present invention, the at least one sliding latch further includes an operating portion connected to the first engaging portion and the at least one second engaging portion.

According to an embodiment of the present invention, the operating portion is fixedly connected to the at least one second engaging portion, and a relief slit is formed on a connection between the operating portion and at least one second engaging portion.

According to an embodiment of the present invention, the operating portion is at least partially exposed out of the second tray body. The first engaging portion is exposed out of the second tray body, and the at least one second engaging portion is received inside the second tray body.

According to an embodiment of the present invention, a sliding slot is formed on the operating portion. A middle portion of the at least one second engaging portion is pivotally installed on the second tray body and located at a position outside the sliding slot. A sliding pin protrudes from an end of the at least one second engaging portion through the sliding slot. Another end of the at least one second engaging portion is adapted for engaging with the at least one lower tube, and the operating portion drives the another end of at least one second engaging portion to pivotally disengage from the at least one lower tube by cooperation of the sliding pin and the sliding slot.

According to an embodiment of the present invention, the sliding pin is driven by the at least one lower tube to slide relative to the sliding slot during a process that the at least one lower tube is inserted into the at least one assembling portion to reach the locking position.

According to an embodiment of the present invention, a slot is formed on the at least one assembling portion and located at a position corresponding to the at least one second engaging portion for allowing the at least one second engaging portion to pass therethrough to engage with the at least one lower tube.

According to an embodiment of the present invention, a ramped surface is formed on a side of the at least one second engaging portion for cooperating with the at least one lower tube during a process that the at least one lower tube is inserted into the at least one assembling portion to reach the locking position.

In order to achieve the aforementioned objective, the present invention further discloses a multi-function high chair includes a child seat, at least one leg component, and a child tray assembly. The at least one leg component is installed on the child seat for supporting the child seat. The child tray assembly is detachably disposed on the child seat, and the child tray assembly includes a first tray and a second tray. The first tray is slidably disposed on the child seat. The first tray includes a first tray body and a first actuator installed on the first tray body for allowing the first tray body to slide relative to the child seat. The second tray is detachably disposed on the first tray. The second tray includes a second tray body and a second actuator installed on the second tray body. The second actuator is located at a position corresponding to the first actuator when the second tray body is disposed on the first tray body. The first actuator is driven by the second actuator to allow the first tray body to slide relative to the child seat when the second tray body is disposed on the first tray body.

In order to achieve the aforementioned objective, the present invention further discloses a multi-function high chair includes a child seat, at least one leg component, and a child tray assembly. The at least one leg component is installed on the child seat for supporting the child seat. The at least one leg component includes an upper tube installed on the child seat and a lower tube detachably connected to the upper tube. The child tray assembly is detachably disposed on the child seat, and the child tray assembly includes at least one support portion and a tray. The at least one support portion is slidably disposed on the child seat. The tray is detachably disposed on the at least one support portion. The tray includes a tray body and at least one sliding latch slidably disposed on the tray body. At least one assembling portion is formed on the tray body for insertion of the lower tube. The at least one sliding latch includes a first engaging portion and at least one second engaging portion. The first engaging portion is for engaging with the at least one support portion. The at least one second engaging portion is for engaging with the lower tube inserted within the at least one assembling portion at a locking position.

According to an embodiment of the present invention, a positioning recess is formed on the lower tube, the at least one second engaging portion engages with the positioning recess when the lower tube is inserted into the at least one assembling portion at the locking position.

In summary, the multi-function high chair of the present invention utilizes the sliding latch for combination of the second tray and the first tray and combination of the second tray and the lower tube or for combination of the tray and the support portion and combination of the tray and the lower tube. Therefore, it is convenient for the caregivers to operate the multi-function high chair of the present invention in different modes according to different situation, so as to allow the caregivers to adequately watch or interact with their children.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
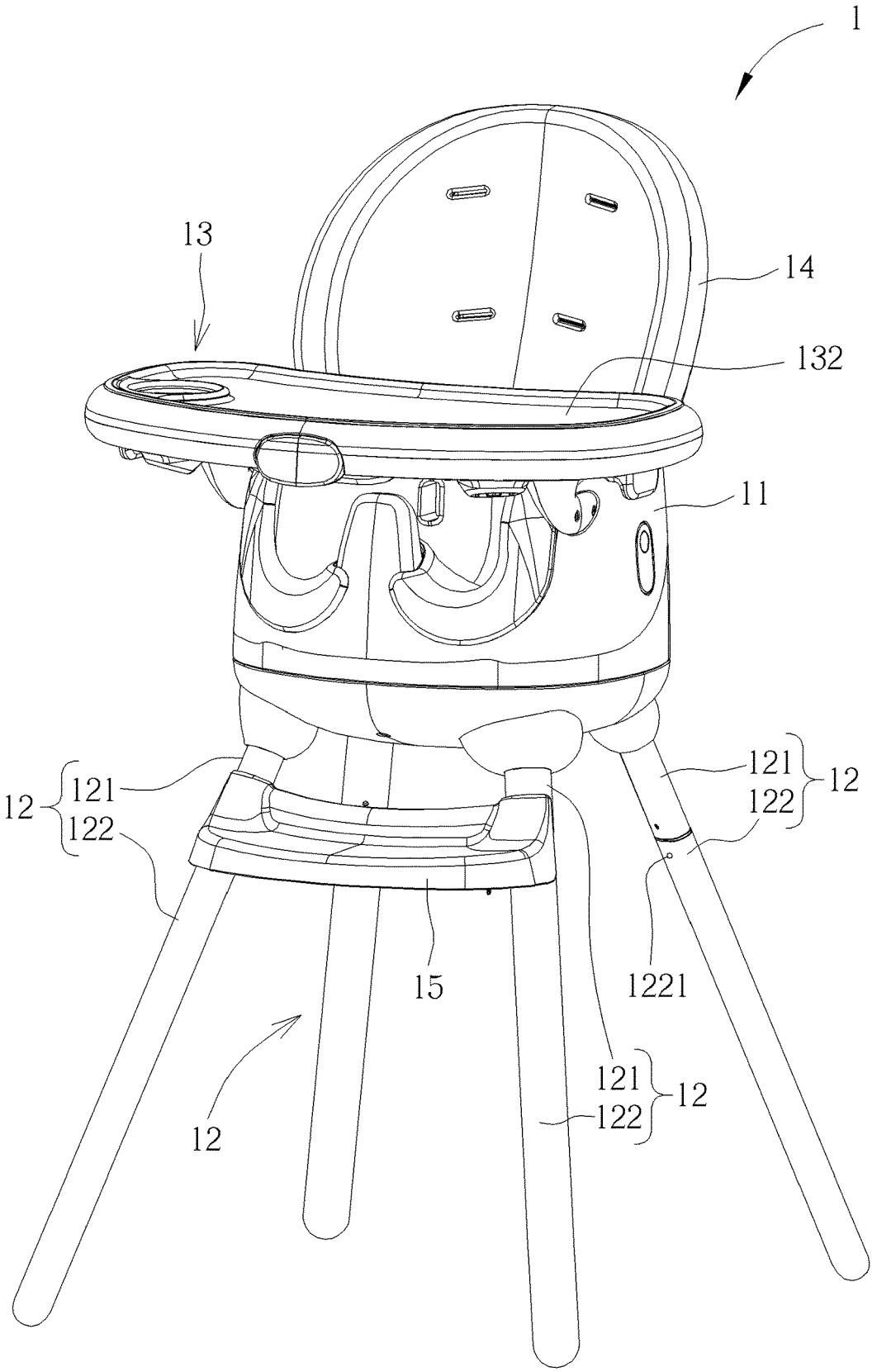
FIG. 1 and FIG. 2 are schematic diagrams of a multi-function high chair in different modes according to a first embodiment of the present invention.
Figure 2:
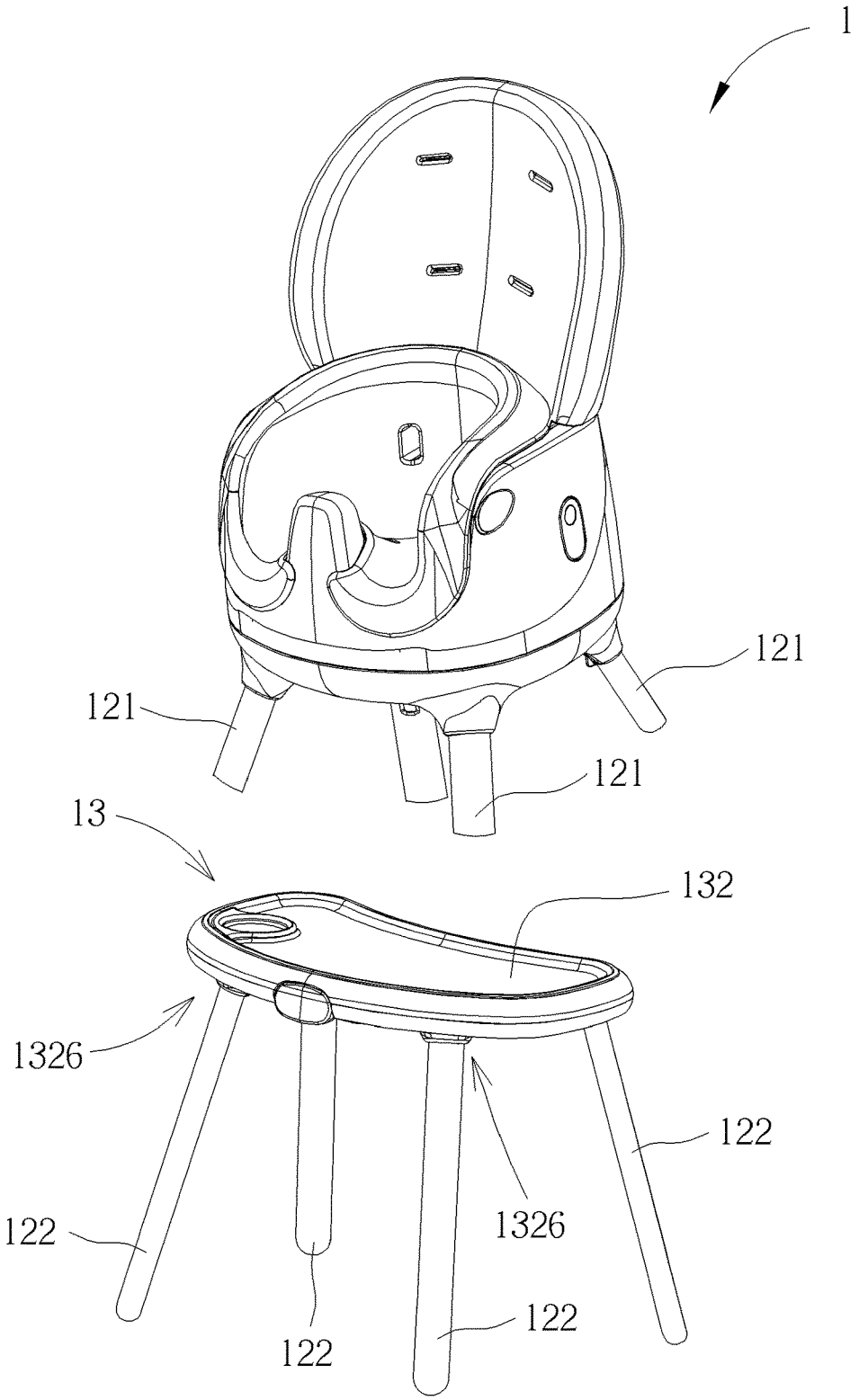

Please refer to FIG. 1 and FIG. 2. FIG. 1 and FIG. 2 are schematic diagrams of a multi-function high chair 1 in different modes according to a first embodiment of the present invention. The multi-function high chair 1 of the present invention can be operated in a first mode as shown in FIG. 1 or in a second mode as shown in FIG. 2. As shown in FIG. 1 and FIG. 2, the multi-function high chair 1 includes a child seat 11, four leg components 12, a child tray assembly 13, a backrest 14 and a footrest 15. The child seat 11 is for accommodating a child. The four leg components 12 are installed on the child seat 11 for supporting the child seat 11. Each of the four leg components 12 includes an upper tube 121 and a lower tube 122. The upper tube 121 is installed with the child seat 11. The lower tube 122 is detachably connected to the upper tube 121. The child tray assembly 13 is detachably disposed on the child seat 11. The backrest 14 is detachably installed on the child seat 11 for supporting the child's back. The footrest 14 is detachably installed on two of the four upper tubes 121 of the four leg components 12 for supporting the child's feet. When the multi-function high chair 1 is in the first mode as shown in FIG. 1, the four lower tubes 122 and the child tray assembly 13 are assembled with the four upper tubes 121 and the child seat 11 respectively, which allows the multi-function high chair 1 to operate as a high chair. When the multi-function high chair 1 is in the second mode as shown in FIG. 2, the four lower tubes 122 and the child tray assembly 13 are detached from the four upper tubes 121 and the child seat 11 respectively, so as to assemble the four lower tubes 122 with a second tray 132 of the child tray assembly 13, which allows the multi-function high chair 1 to operate as a low chair and a small table.

Figure 3:
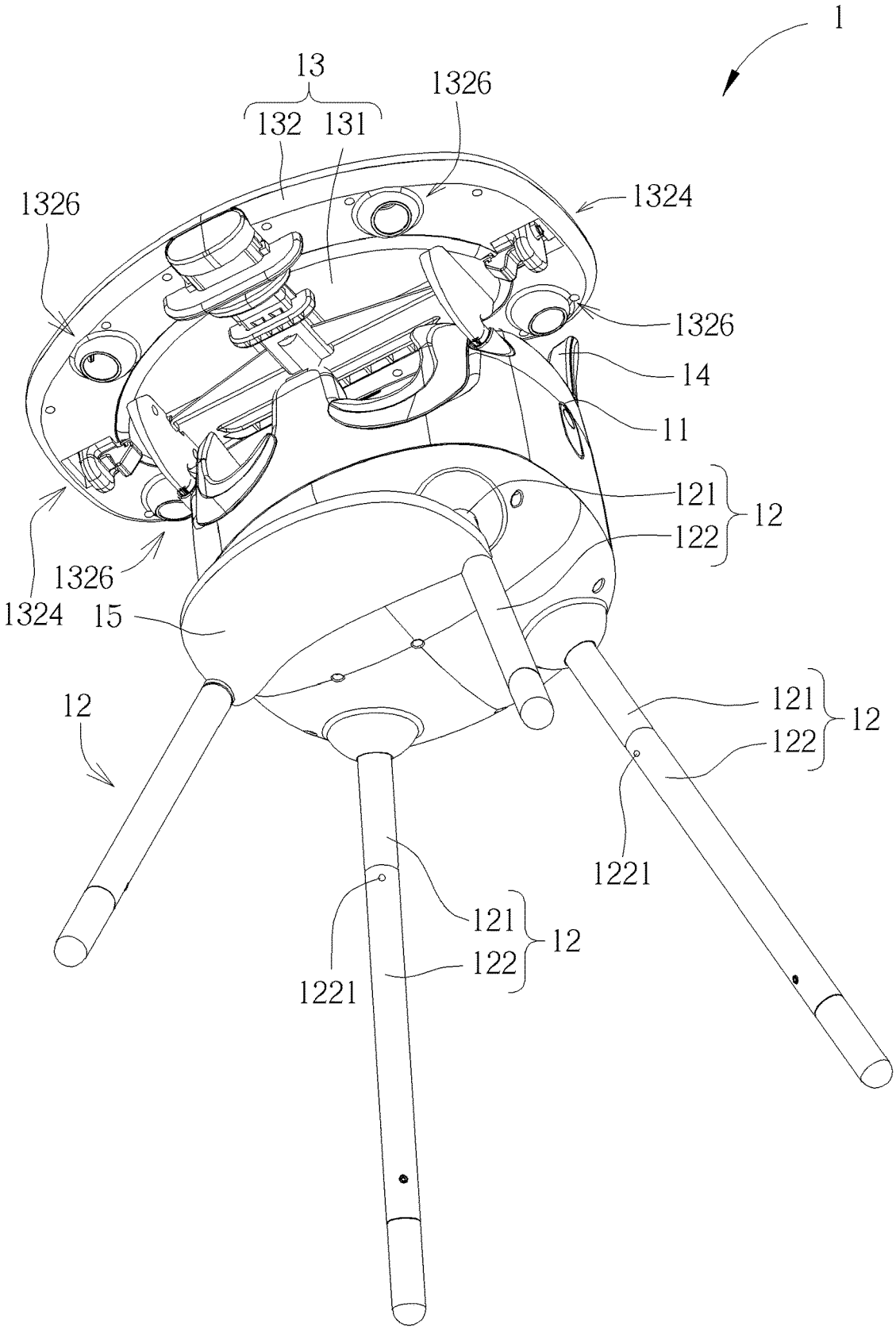
FIG. 3 is another schematic diagram of the multi-function high chair at another view in a first mode according to the first embodiment of the present invention.
Figure 4:
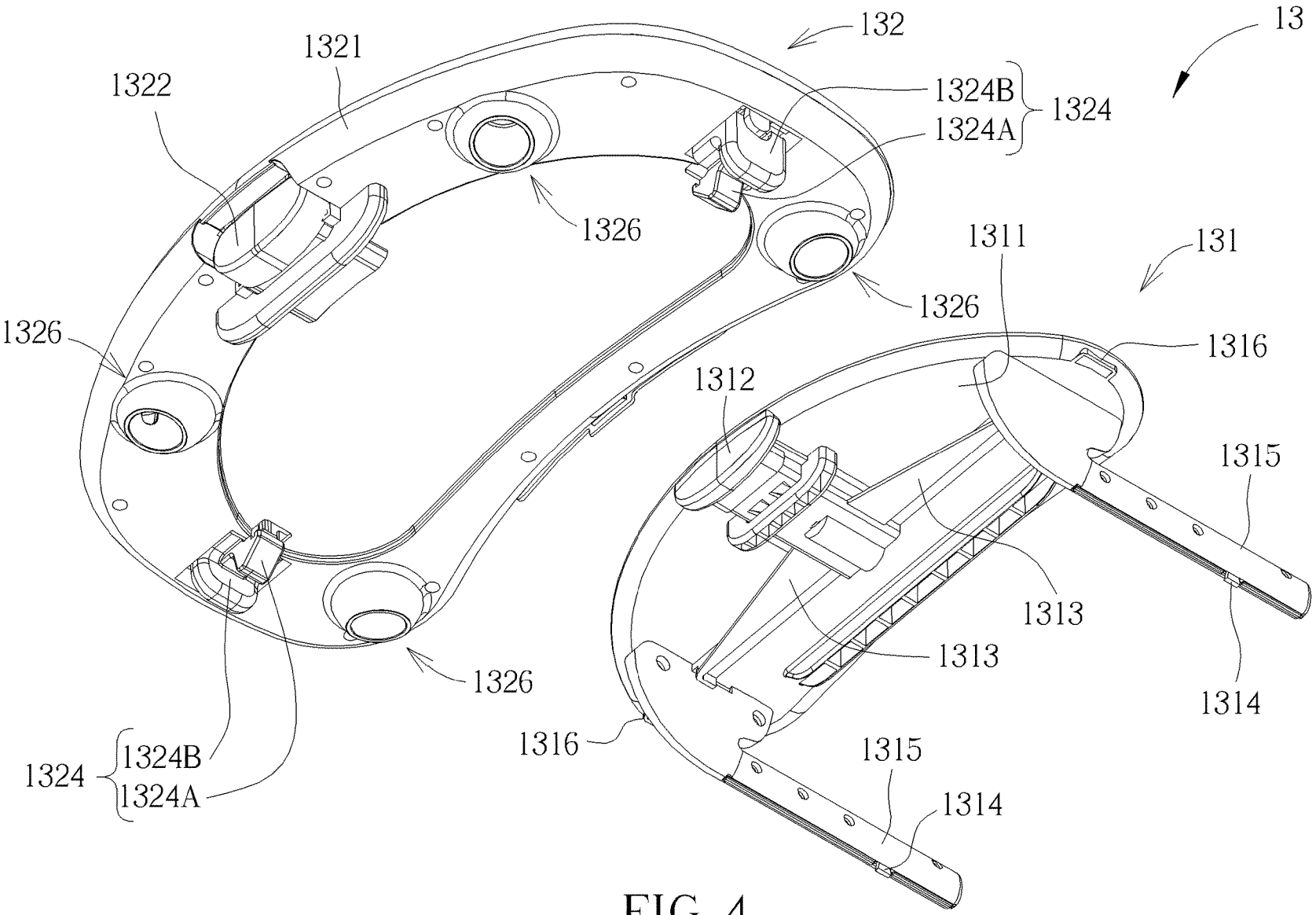
FIG. 4 is a partial exploded diagram of a child tray assembly according to the first embodiment of the present invention.

Please refer to FIG. 3 and FIG. 4. FIG. 3 is another schematic diagram of the multi-function high chair 1 at another view in the first mode according to the first embodiment of the present invention. FIG. 4 is a partial exploded diagram of the child tray assembly 13 according to the first embodiment of the present invention. As shown in FIG. 1 to FIG. 4, the child tray assembly 13 includes a first tray 131 and the second tray 132 larger than the first tray 131. The second tray 132 is detachably disposed on the first tray 131, so that caregivers can selectively equip the child seat 11 with the first tray 131 only or the first tray 131 with the larger second tray 132 when the multi-function high chair 1 is in the first mode.

The first tray 131 includes a first tray body 1311, a first actuator 1312, two driven components 1313, two engaging components 1314 and two sliding tracks 1315. The two sliding tracks 1315 are installed on the first tray body 1311, so that the first tray body 1311 can be slidably disposed on the child seat 11 by the two sliding tracks 1315. The first actuator 1312, which can be a push button, is installed on the first tray body 1311 and located on a front side of the first tray body 1311. The two engaging components 1314 are movably disposed on the two sliding tracks 1315 respectively for restraining or allowing sliding movement of the first tray body 1311 relative to the child seat 11. Each of the two driven components 1313 is connected to the first actuator 1312 and the corresponding engaging component 1314. In such a way, the first actuator 1312 can drive the two driven components 1313 to disengage the two engaging components 1314 from the child seat 11 to allow the first tray body 1311 to slide relative to the child seat 11 when the first actuator 1312 is operated.

Figure 5:
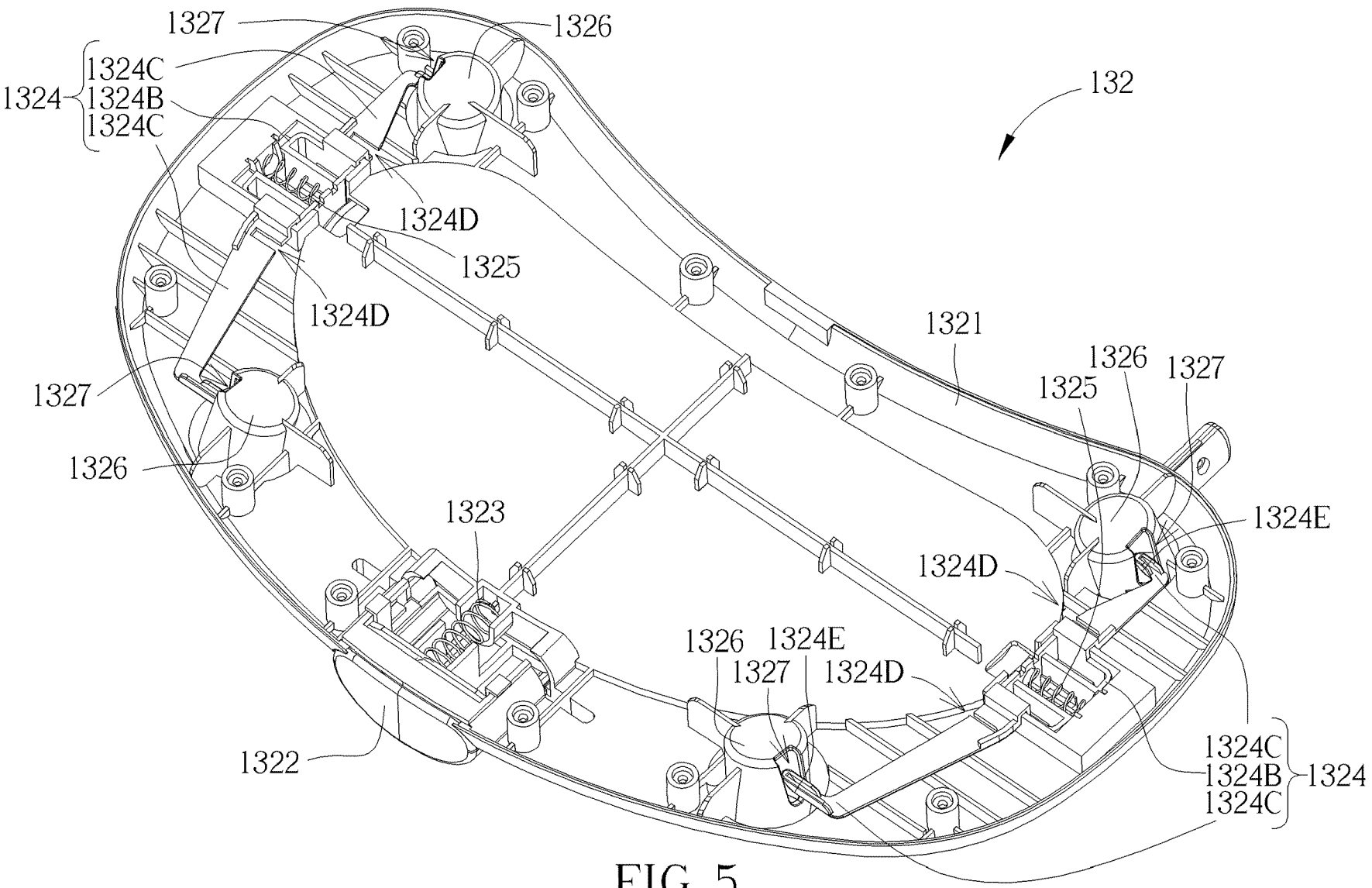
FIG. 5 is a partial internal structural diagram of a second tray according to the first embodiment of the present invention.

Please refer to FIG. 3 to FIG. 5. FIG. 5 is a partial internal structural diagram of the second tray 132 according to the first embodiment of the present invention. As shown in FIG. 4 and FIG. 5, the second tray 132 includes a second tray body 1321, a second actuator 1322 and a resilient component 1323. The second actuator 1322 is installed on the second tray body 1321 and located at a position corresponding to the first actuator 1312. The resilient component 1323 abuts against the second actuator 1322 to bias the second actuator 1322 to separate from the first actuator 1312, so as to prevent mechanical interference between the second actuator 1322 and the first actuator 1312 during installation or removal of the second tray 132 relative to the first tray 131. In such a way, the first actuator 1312 can be driven by the second actuator 1322 to allow the first tray body 1311 to slide relative to the child seat 11 when the second tray 132 is disposed on the first tray 131 as shown in FIG. 3.

However, the numbers and the configurations of the first actuator 1312, the driven component 1313, the engaging component 1314, the sliding track 1315 and the second actuator 1322 are not limited to those illustrated in the figures of this embodiment. It depends on practical demands.

Furthermore, as shown in FIG. 3 to FIG. 5, in this embodiment, two engaging recesses 1316 are formed on two opposite sides of the first tray body 1311. The second tray 132 further includes two sliding latches 1324 and two recovering components 1325. Each of the two sliding latches 1324 is slidably disposed on the second tray body 1321 and located at a position corresponding to the corresponding engaging recess 1316 for engaging with or disengaging from the corresponding engaging recess 1316. Each of the two recovering components 1325 is connected to the corresponding sliding latch 1324 to bias the corresponding sliding latch 1324 to engage with the corresponding engaging recess 1316. Specifically, each of the two sliding latches 1324 includes a first engaging portion 1324A and an operating portion 1324B. The first engaging portion 1324A is for engaging with the corresponding engaging recess 1316 on the first tray body 1311. The operating portion 1324B is connected to the first engaging portion 1324A and capable of being operated for disengaging the first engaging portion 1324A from the corresponding engaging recess 1316. In such a way, the second tray body 1321 can be combined with or detached from the first tray body 1311 by engagement or disengagement of the two first engaging portions 1324A of the two sliding latches 1324 and the two engaging recesses 1316 easily. Therefore, the multi-function high chair 1 of the present application can provide the second tray body 1321 or the first tray body 1311 with different sizes selectively according to actual demands.

Besides, as shown in FIG. 2 to FIG. 5, four assembling portions 1326 are formed on the second tray body 1321 for insertion of the four lower tubes 122 of the four leg components 12. A slot 1327 is formed on each of the four assembling portions 1326. Each of the two sliding latch 1324 further includes two second engaging portions 1324C fixedly connected to the operating portion 1324B. The slot 1327 is located at a position corresponding to the corresponding second engaging portion 1324C for allowing the corresponding second engaging portion 1324C to pass therethrough to engage with the corresponding lower tube 122. A relief slit 1324D is formed on a connection between the operating portion 1324B and each of the two second engaging portions 1324C for allowing the corresponding second engaging portion 1324C to be bent relative to the operating portion 1324B. A ramped surface 1324E is formed on a side of each of the two second engaging portions 1324C for cooperating with the corresponding lower tube 122 during the insertion of the corresponding lower tube 122 into the assembling portion 1326.

In this embodiment, in order for easy operation and improvement of aesthetic appearance, the operating portion 1324B can be preferably at least partially exposed out of the second tray body 1321. The first engaging portion 1324A can be preferably exposed out of the second tray body 1321. The second engaging portion 1324C can be preferably received inside the second tray body 1321. A positioning recess 1221 can be preferably formed on each of the lower tube 122, as shown in FIG. 1 and FIG. 2, so that the second engaging portion 1324C can engage with the positioning recess 1221 when the lower tube 121 is inserted into the assembling portion 1326 at a locking position. However, it is not limited to this embodiment.

Figure 6:
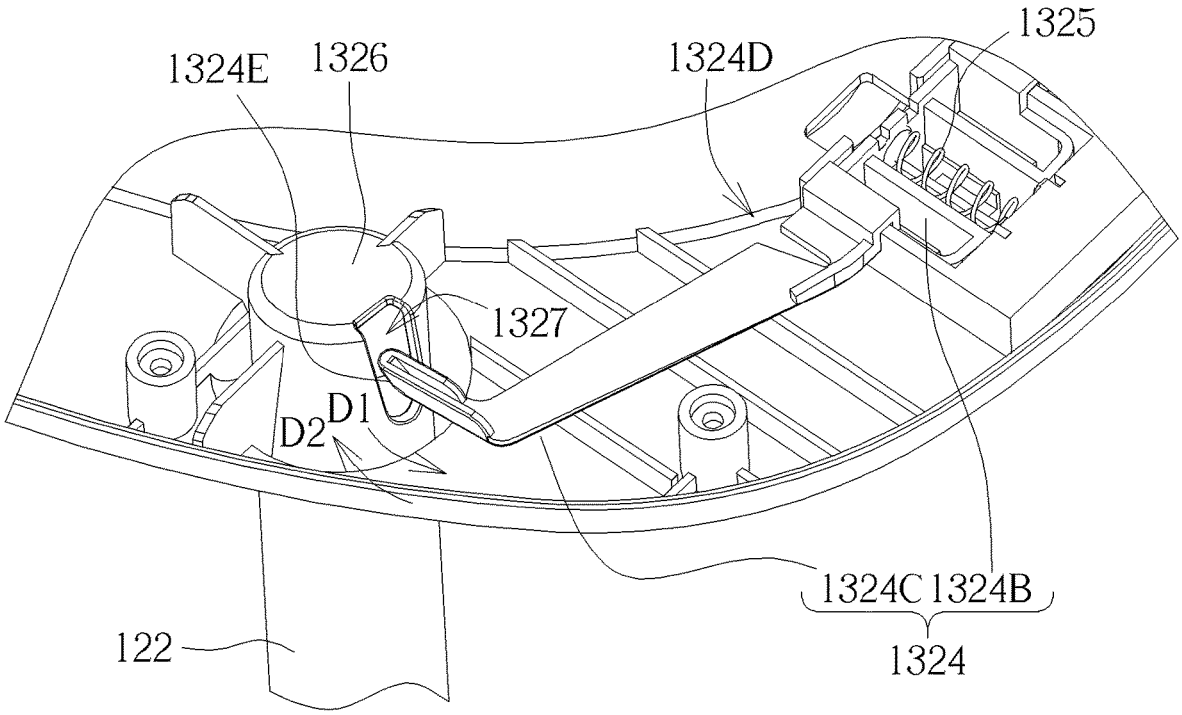
FIG. 6 and FIG. 7 are partial internal structural diagrams of the second tray indifferent states according to the first embodiment of the present invention.
Figure 7:
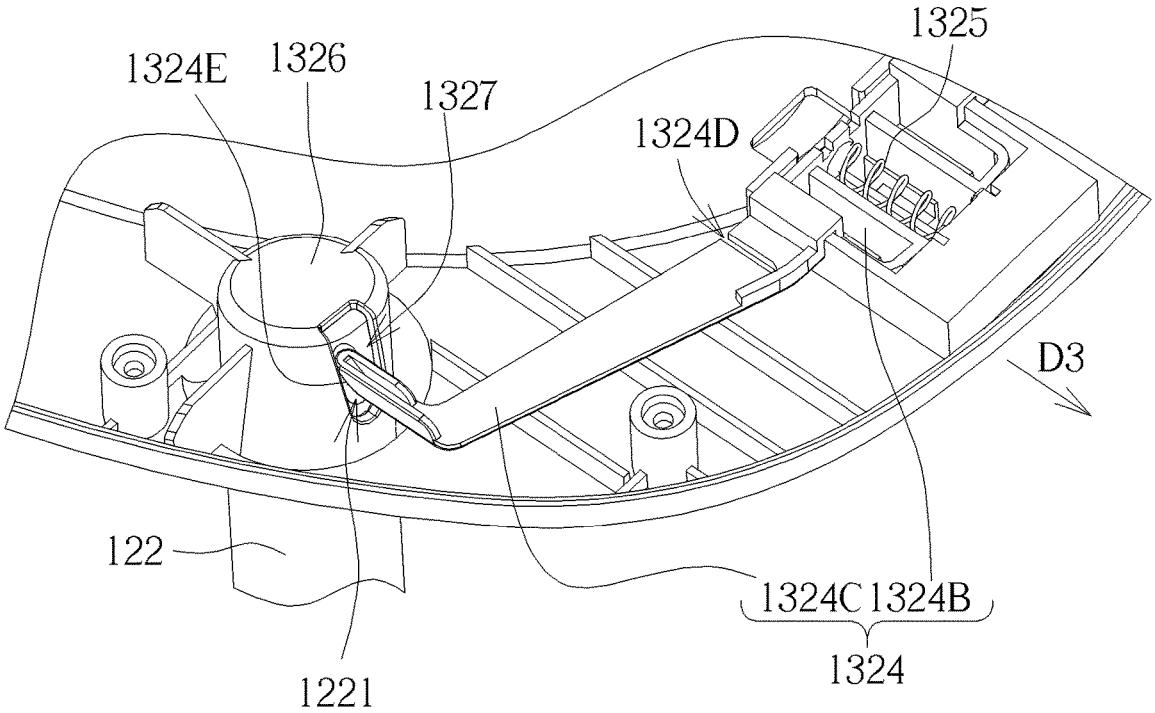

Please refer to FIG. 6 and FIG. 7. FIG. 6 and FIG. 7 are partial internal structural diagrams of the second tray 132 in different states according to the first embodiment of the present invention. In order to illustrate operational principle of the sliding latch 1324 of the present invention, the lower tube 122, the assembling portion 1326 and the second sliding latch 1324 at one corner of the second tray 132 are illustrated in FIG. 6 and FIG. 7. The four lower tubes 122 can be detached from the four upper tubes 121, and the second tray 132 can be detached from the first tray 131 which is detached from the child seat 11. Then, during the insertion of the lower tube 122 into the assembling portion 1326 on the second tray body 1321, the lower tube 122 cooperates with the ramped surface 1324E, so that the second engaging portion 1324C can be forced to be bent along a first direction D1 relative to the operating portion 1324B to a position as shown in FIG. 6, by the relief slit 1324D. When the lower tube 122 reaches the locking position, as shown in FIG. 7, the positioning recess 1221 is aligned with the second engaging portion 1324C, so that the second engaging portion 1324C can resiliently recover along a second direction D2 opposite to the first direction D1 to engage with the positioning recess 1221 to restrain the lower tube 122 from moving relative to the second tray body 1321. At this moment, the four lower tubes 122 and the second tray body 1321 can form a small table cooperatively, as shown in FIG. 2. On the other hand, when it is desired to detach the lower tube 122 from the second tray body 1321, the operating portion 1324B can be pulled outwardly along a third direction D3 to disengage the second engaging portion 1324C from the positioning recess 1221. At this moment, the lower tube 122 can be detached from the second tray body 1321 easily.

Figure 8:
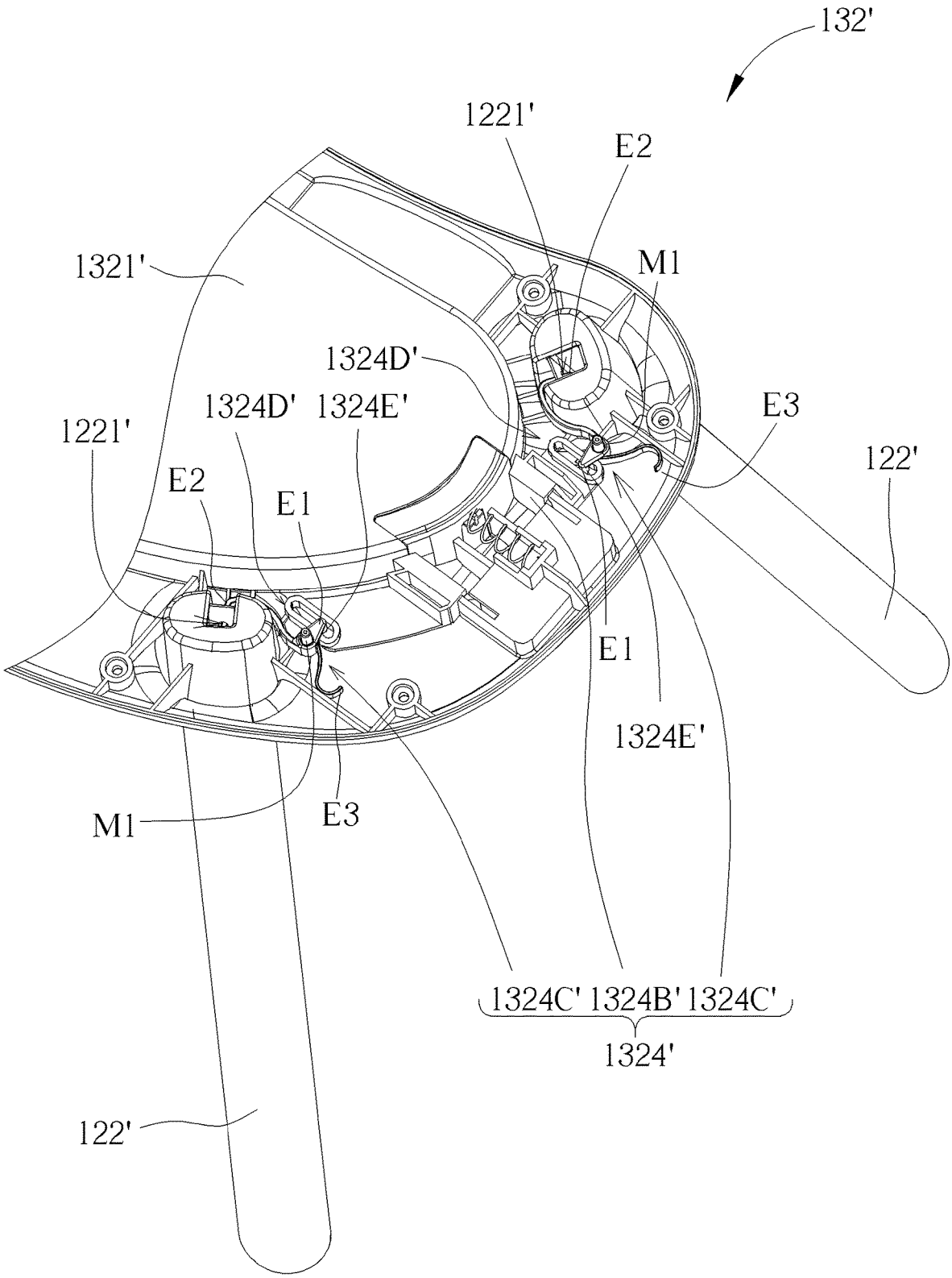
FIG. 8 is a partial internal structural diagram of a second tray according to a second embodiment of the present invention.
Figure 9:
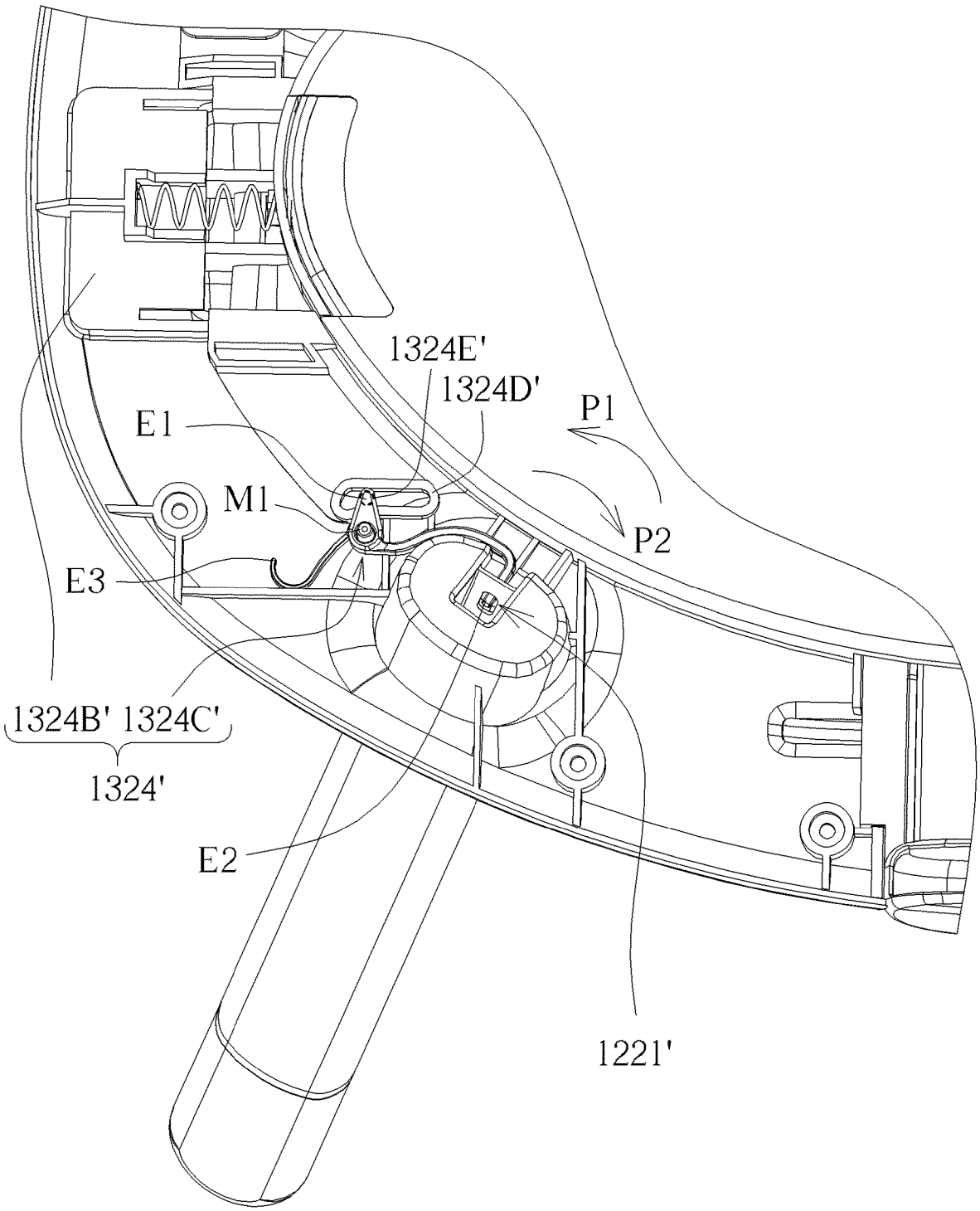
FIG. 9 and FIG. 10 are partial internal structural diagrams of the second tray in different states according to the second embodiment of the present invention.
Figure 10:
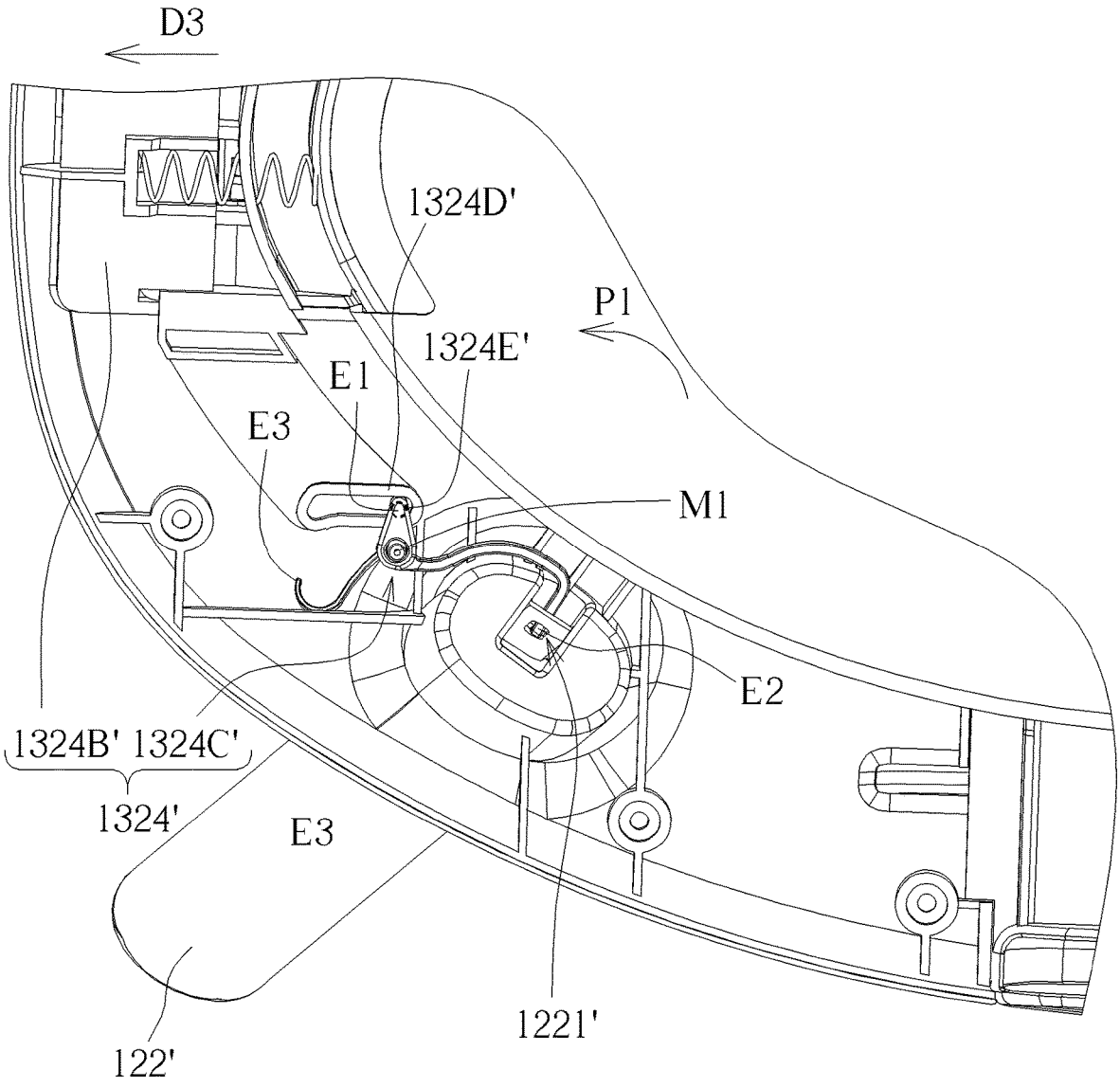

Please refer to FIG. 8 to FIG. 10. FIG. 8 is a partial internal structural diagram of a second tray 132' according to a second embodiment of the present invention. FIG. 9 and FIG. 10 are partial internal structural diagrams of the second tray 132' in different states according to the second embodiment of the present invention. As shown in FIG. 8, different from the first embodiment, the second tray 132' of the second embodiment includes two sliding latches 1324'. Each of the two sliding latches 1324' includes a first engaging portion, which is not shown in figures, an operating portion 1324B' and two second engaging portions 1324C' movably connected to the operating portion 1324B'. Structure and operational principle of the first engaging portion of this embodiment are similar to those of the first engaging portion 1324A of the first embodiment. Description is omitted herein for simplicity. Specifically, in this embodiment, two sliding slots 1324D' are formed on the operating portion 1324B'. A sliding pin 1324E' protrudes from an end E1 of each of the two second engaging portions 1324C' through the corresponding sliding slot 1324D'. A middle portion M1 of each of the two second engaging portions 1324C' is pivotally installed on a second tray body 1321' of the second tray 132' and located at a position outside the corresponding sliding slot 1324D'. Another end E2 of each of the two second engaging portions 1324C' is adapted for engaging with the corresponding lower tube 122'. Furthermore, the other end E3 of each of the two second engaging portions 1324C' abuts against the second tray body 1321' to bias the end E1 of the each of the two second engaging portions 1324C' to engage with the corresponding lower tube 122'.

As shown in FIG. 9, in this embodiment, during insertion of the lower tube 122', the second engaging portion 1324C' is forced by the lower tube 122' to pivot along a first pivoting direction P1 to drive the sliding pin 1324E' to slide relative to the sliding slot 1324D'. When the lower tube 122' reaches the locking position, a positioning recess 1221' on the lower tube 122' is aligned with the end E1 of the second engaging portion 1324C', so that the second engaging portion 1324C' can resiliently recover along a second pivoting direction P2 opposite to the first pivoting direction P1 to engage the end E1 of the second engaging portion 1324C' with the positioning recess 1221'. On the other hand, when it is desired to detach the lower tube 122' from the second body 1321', the operating portion 1324B' can be pulled outwardly along the third direction D3 to drive the second engaging portion 1324C' to pivot along the first pivoting direction P1 by cooperation of the sliding pin 1324E' and the sliding slot 1324D', so that the end E1 of the second engaging portion 1324C' is disengaged from the positioning recess 1221' as shown in FIG. 10. At this moment, the lower tube 122' can be detached from the second tray body 1321'.

Figure 11:
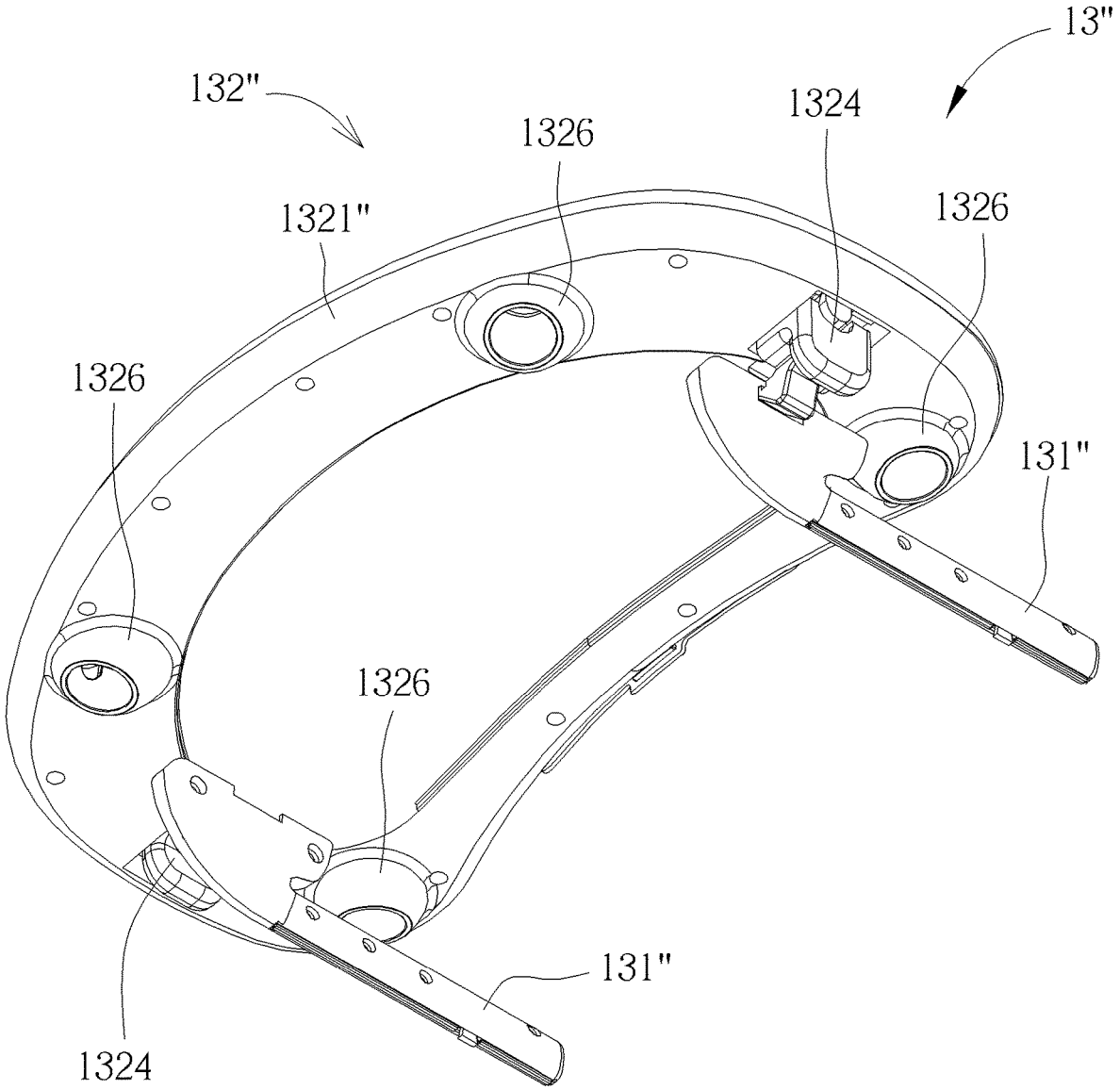
FIG. 11 is a diagram of a child tray assembly according to a third embodiment of the present invention.

However, it should be noticed that structure of the child tray assembly of the present invention is not limited to the aforementioned embodiments. It depends on practical demands. For example, please refer to FIG. 11. FIG. 11 is a diagram of a child tray assembly 13" according to a third embodiment of the present invention. As shown in FIG. 11, the child tray assembly 13" includes two support portions 131" and a tray 132". In this embodiment, the two support portions 131" are slidably disposed on the child seat 11, which is not shown in figure, and the tray 132" is detachably disposed on the two support portions 132". In other words, the child tray assembly 13" of this embodiment has only one size. Furthermore, the engaging recess 1316 can be formed on each of the two support portions 131". The tray 132" can include a tray body 1321" and the sliding latch 1324. The four assembling portions 1326 are formed on the tray body 1321". The sliding latch 1324 is slidably disposed on the tray body 1321" for selectively engaging with the lower tube 122, which is not shown in the figure, or the support portion 131". Besides, in another embodiment, the tray 132" also can replace the sliding latch 1324 of the first embodiment with the sliding latch 1324' of the second embodiment. For simplicity, elements that have the same structures and functions as that illustrated in the aforementioned embodiment are provided with the same item numbers in this embodiment.

In contrast to the prior art, the multi-function high chair of the present invention utilizes the sliding latch for combination of the second tray and the first tray and combination of the second tray and the lower tube or for combination of the tray and the support portion and combination of the tray and the lower tube. Therefore, it is convenient for the caregivers to operate the multi-function high chair of the present invention in different modes according to different situations, so as to allow the caregivers to adequately watch or interact with their children.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child tray assembly adapted for a child seat, the child tray assembly comprising:

a first tray slidably disposed on the child seat, the first tray comprising a first tray body and a first actuator installed on the first tray body for allowing the first tray body to slide relative to the child seat; and a second tray detachably disposed on the first tray, the second tray comprising a second tray body and a second actuator installed on the second tray body, the second actuator being located at a position corresponding to the first actuator when the second tray body is disposed on the first tray body, the first actuator being driven by the second actuator to allow the first tray body to slide relative to the child seat when the second tray body is disposed on the first tray body.

2. The child tray assembly of claim 1, wherein the first tray further comprises a driven component and an engaging component, and the driven component is connected to the first actuator and the engaging component, and the first actuator drives the driven component to disengage the engaging component from the child seat to allow the first tray body to slide relative to the child seat.

3. The child tray assembly of claim 1, wherein the first tray further comprises at least one sliding track installed on the first tray body, and the first tray body is slidably disposed on the child seat by the at least one sliding track.

4. The child tray assembly of claim 1, wherein the first actuator is located on a front side of the first tray body, and the second actuator is located on a front side of the second tray body.

5. The child tray assembly of claim 1, wherein the second tray further comprises a resilient component abutting against the second actuator to bias the second actuator to separate from the first actuator.

6. A multi-function high chair comprising:

a child seat;

at least one leg component installed on the child seat for supporting the child seat; and a child tray assembly detachably disposed on the child seat, and the child tray assembly comprising:

a first tray slidably disposed on the child seat, the first tray comprising a first tray body and a first actuator installed on the first tray body for allowing the first tray body to slide relative to the child seat; and a second tray detachably disposed on the first tray, the second tray comprising a second tray body and a second actuator installed on the second tray body, the second actuator being located at a position corresponding to the first actuator when the second tray body is disposed on the first tray body, the first actuator being driven by the second actuator to allow the first tray body to slide relative to the child seat when the second tray body is disposed on the first tray body.

7. The multi-function high chair of claim 6, wherein the first tray further comprises a driven component and an engaging component, and the driven component is connected to the first actuator and the engaging component, and the first actuator drives the driven component to disengage the engaging component from the child seat to allow the first tray body to slide relative to the child seat.

8. The multi-function high chair of claim 6, wherein the first tray further comprises at least one sliding track installed on the first tray body, and the first tray body is slidably disposed on the child seat by the at least one sliding track.

9. The multi-function high chair of claim 6, wherein the first actuator is located on a front side of the first tray body, and the second actuator is located on a front side of the second tray body.

10. The multi-function high chair of claim 6, wherein the second tray further comprises a resilient component abutting against the second actuator to bias the second actuator to separate from the first actuator.

* * * * *